United States Patent [19]

Nolet

[11] 4,071,999

[45] Feb. 7, 1978

[54] MACHINE FOR BAG CLOSING AND SEALING

[76] Inventor: Jean-Yves Nolet, 70 Dubois Street - R.R. 2, St. Nicephore, Drummond, Canada

[21] Appl. No.: 755,429

[22] Filed: Dec. 29, 1976

[51] Int. Cl.[2] ..... B65B 7/06; B65B 51/14

[52] U.S. Cl. ..... 53/373

[58] Field of Search ..... 53/371, 372, 373

[56] References Cited

U.S. PATENT DOCUMENTS

| | | | |
|---|---|---|---|
| 2,168,241 | 8/1939 | Robinson | 53/371 |
| 2,237,911 | 4/1941 | Neumair | 53/371 X |
| 2,243,805 | 5/1941 | Knapp | 53/371 |
| 2,624,995 | 1/1953 | Allen | 53/371 |
| 2,641,882 | 6/1953 | Richard | 53/373 |
| 2,712,210 | 7/1955 | Sawyer et al. | 53/371 X |
| 2,840,964 | 7/1958 | Kissling | 53/373 X |
| 3,115,736 | 12/1963 | Peterson | 53/371 |
| 3,220,161 | 11/1965 | Lohse et al. | 53/373 |
| 3,470,795 | 10/1969 | Davis, Jr. | 53/372 X |

*Primary Examiner*—Othell M. Simpson
*Assistant Examiner*—Horace M. Culver

[57] ABSTRACT

A machine for closing and sealing a plastic bag filled with material, such as, for instance, peat moss. The machine includes a carriage which moves around the top open end of the filled bag, hook-shaped fingers carried by the carriage, pivot down into the open mouth of the bag to catch the four corners of the same, oppositely disposed pusher fingers engage opposite walls of the bag, each intermediate a set of two hooking fingers to tension the bag wall horizontally. Then the hooking fingers gradually move down at an angle to converge in pairs at the two opposite sides of the bag mouth and, simultaneously, the pusher fingers continue to push intermediate wall portions inwardly to, all the time, maintain the bag mouth wall taut and to form opposite folds in the mouth, thereby closing the mouth. The hooking and pushing fingers are then moved in an out-of-the way position and, immediately thereafter, a heat sealer, provided with a fixed and a pivoted jaw, clamps the closed mouth and heat-seals the same and, simultaneously, cuts off the surplus wall material above the seal. Then the machine retracts to clear the sealed bag which can be removed and replaced by another filled bag to be closed and sealed. The entire closing and sealing operation is effected while the bag is in upright position. Thus peat moss, or other material, does not become trapped between the mouth walls during the closing and sealing operation and a completely air-tight and liquid-tight seal is obtained.

7 Claims, 17 Drawing Figures

MACHINE FOR BAG CLOSING AND SEALING

The present invention relates to a machine for closing bags filled with material.

In known bag-closing machines, at least the bag mouth has to be inclined or positioned horizontally to close the mouth and it frequently happens that the material filling the bag becomes trapped between the walls of the mouth being brought together, resulting in an imperfect sealing of the bag mouth.

This is highly detrimental to the bag content, especially, for instance, when the bag contains peat moss and the like material which has to be completely sealed from external humidity. Hygroscopic material, such as salt, also requires perfect closing and sealing of the bag.

It is therefore the main object of the present invention to provide a machine which automatically closes the mouth of a filled bag, while the bag walls remain in an upright position, so that the material filling the bag in no way gets caught between the mouth walls in the final closed position.

Another object of the present invention resides in the provision of a machine of the character described, which not only closes the mouth walls but seals the same in closed position in such a way as to provide a perfectly fluid-tight seal.

Another object of the invention is to provide a machine of a character described, which can accommodate bags of different cross-sectional areas.

Another object of the invention is to provide a machine of the character described including a heat sealing system to automatically heat-seal the closed mouth of the plastic bags.

Another object of the invention is to provide a machine of the character described which is very fast in operation and is completely automatic.

The foregoing and other objects of the present invention will become more apparent during the following disclosure and by referring to the drawings, in which.

Figure 10:
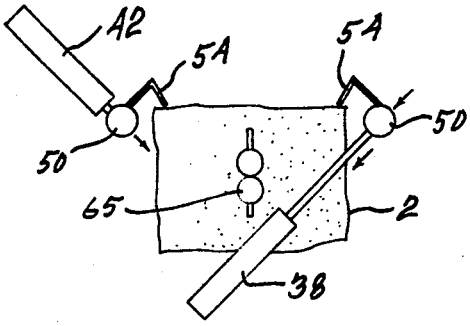
FIG. 10 is a schematic view, in elevation, of the bag mouth with the pusher and hooking fingers about to engage the same.
Figure 12:
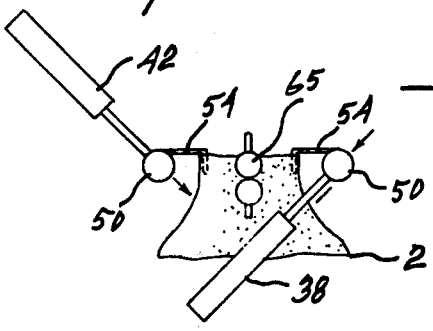
FIG. 12 is a partial side elevation, similar to that of FIG. 10, but showing how the various fingers have reached an intermediate position.
Figure 13:
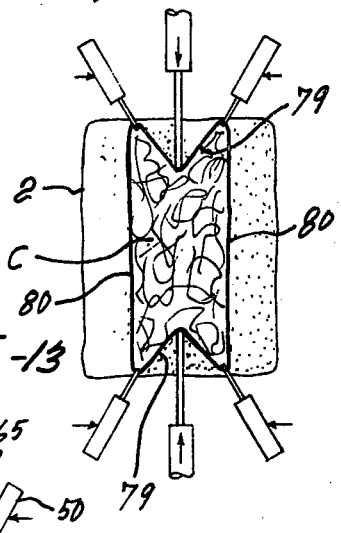
Figure 14:
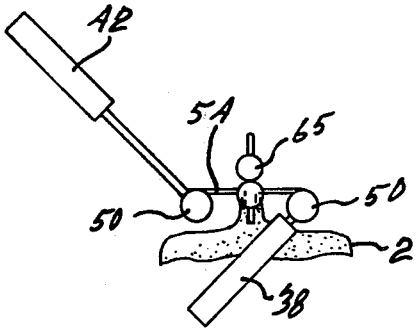
Figure 15:
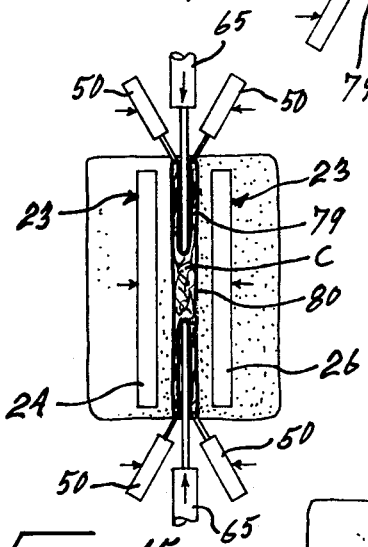
Figure 16:
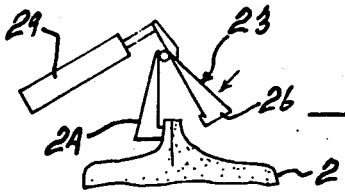
Figure 17:
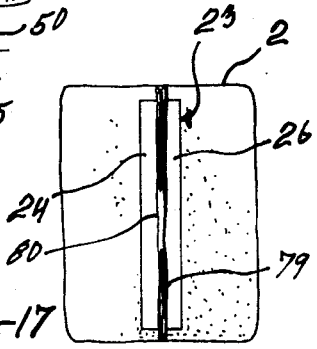

FIG. 13 corresponds to the position of FIG. 12, shown in top plan view;

FIG. 14 is a side elevation consecutive to the steps of FIGS. 10 and 12 showing the bag mouth in closed position;

FIG. 15 is a top plan view of the condition of the system shown in FIG. 14;

FIG. 16 shows the heat sealer about to clamp the folded and closed mouth; and FIG. 17 is a top plan view of the bag mouth and heat sealer jaws clamping the same.

In the drawings, like reference characters indicate like elements throughout.

Figure 1:
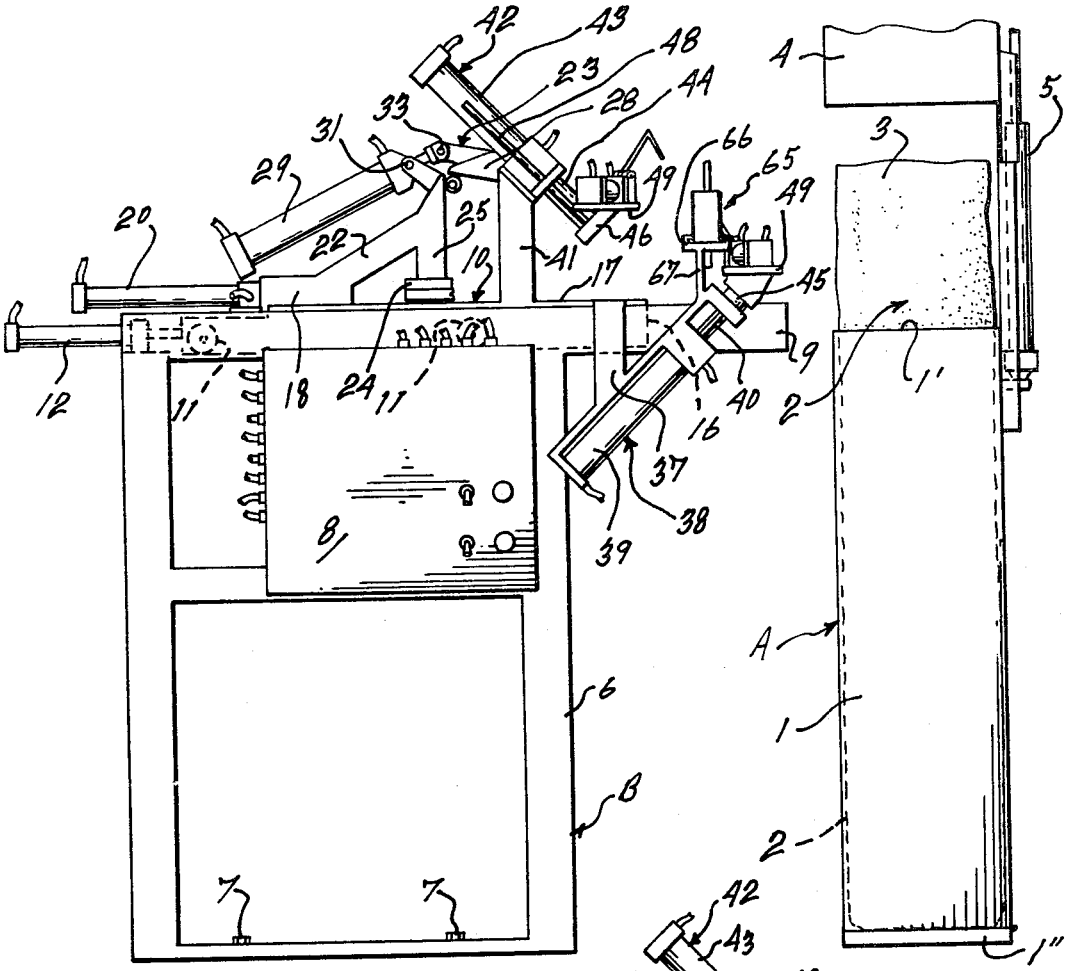
FIG. 1 is a side elevation of the bag closing and sealing machine of the invention to retracted position adjacent a bag-filling station.

FIG. 1 shows in side elevation a bag-closing station, indicated at A, beside which is located the machine of the invention, generally indicated at B. Station A includes an upright duct 1, of a cross-section size, to guide a bag 2 filled with material C, such as peat moss, in upright position with the walls 3 of the mouth of said bag being upright and open. Duct 1 at the bag-closing station A is part of a duct work vertically extending through the floor on which the machine B is located and has a trap door 1'' at the level of the floor which temporarily retains a filld bag 2 in the position shown with its mouth walls 3 extending above the top edge 1' of the duct section 1.

After the bag has been closed and sealed by the machine of the invention, the trap door 1'' opens within the duct and the closed and sealed bag drops to a floor below. With the trap door closed, an upper duct section 4 moves down below the top edge 1' of section 1 under the action of a ram 5 and another filled bag drops through the upper duct section 4, for instance, from an upper floor to the station A. Then the upper duct section 4 is raised by ram 5 and a new bag is ready to be closed by the machine B.

In the position shown in FIG. 1, the upper duct section 4 is sufficiently raised to completely clear the mouth walls 3.

The machine B in accordance with the invention includes a stand 6 firmly secured to the floor by means of bolts 7, or the like, and carrying on one side a box 8 housing the controls of the various cylinder and piston units of the machine, these controls including electromechanical valves for the varous valves hydraulic circuits and electric circuits connected to the various limit switches, or other sensors, not shown, for carrying out the sequence of movements of the various movable parts.

The top of stand 6 carries the pair of spaced parallel channel members 9 aligned in the direction of the bag-closing station A and, more particularly, each disposed along a line extending on the outside of the lower duct 1 and just above the top edge 1' of the latter.

A rectangular outer carriage 10 is provided along its side with two pairs of wheels 11 in rolling engagement with the bottom flange of the respective channel members 9, so that outer carriage 10 can move back and forth with respect to the stand 6 in a direction towards and away from the bag closing A. This movement is achieved by a hydraulic cylinder and piston unit 12, one end of the cylinder of which is secured to block 13, itself secured to a cross member 14 of the stand 6, and the piston rod of which is secured to the center of cross member 15 of the outer carriage 10.

Figure 5:
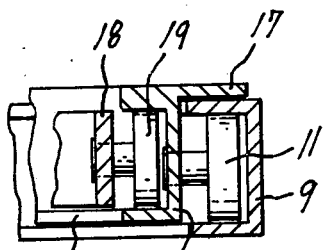
FIG. 5 is a partial cross-section of the multi-carriage system taken along line 5—5 of FIG. 2.

As shown in FIG. 5, at least the sides 16 of outer carriage 10 have a channel shape cross-section directed towards the center of the carriage and a top flange 17 extending outwardly and overlying the channel members 9 of the stand 6.

An inner carriage 18 is movably carried by the outer carriage 10 and is displaceable with respect to the latter and with respect to stand 6 in a direction parallel to the movement of the outer carriage, that is towards and away from the bag-closing station A. Inner carriage 18 consists of a rigid rectangular frame with four supporting wheels 19 at its corners, which rollably engage the channel-shaped sides 16 of the outer carriage 10, as shown in FIG. 5.

Inner carriage 18 is movable back and forth with respect to the outer carriage by means of a hydraulic double-acting cylinder and piston unit 20, the cylinder of which is secured at one end to a transverse member of the inner carriage 18 at the center thereof and freely extends rearwardly. The piston rod of cylinder 20 is attached to the transverse member of the inner carriage 18. Thus, actuation of the first cylinder unit 12 causes to-and-fro movement of both carriages 10 and 18 on the stand 6 and actuation of the second cylinder unit 20 will cause movement of the inner carriage 18 with respect to the outer carriage 10.

Inner carriage 18 has forwardly and upwardly extending arms 22 supporting a heat sealer 23. One jaw 24 of the heat sealer is rigidly secured to arms 22 by means of downwardly extending legs 25. The other jaw 26 of the heat sealer is hinged at 27 to the outer end of arms 22, this hinge being horizontal and transverse to the direction of movement of the two carriages and above the same. The jaw 26 is power-pivoted between an open position in which the legs 28 of this jaw 26 are substantially at right angles to the legs 25 of the fixed jaw and a closed position in which the two sets of legs are parallel with the jaws close to each other to clamp thermoplastic bag walls in between to heat-seal the bag walls together. The pivoted jaw 26 is moved between the two positions by means of two-way acting hydraulic actuator 29, one end of the hydraulic cylinder 30 of which is pivoted at 31 to a pair of lugs 30 fixed to a cross member 21 secured to the outer ends of arms 22. The piston rod of the hydraulic actuator 29 is pivotally attached at 33 to a bracket 34 fixed to a cross member 28' which is secured to the legs 28 of the pivoted jaw 26, the pivot 33 being disposed above the hinge 27. The jaws 24 and 26 are of similar construction and comprise elongated blocks 35 housing an electric heating resistance element, not shown, connected to a suitable supply of electricity for heating blocks 35 which are provided at their facing surfaces with at least two transversely extending parallel flat faced ribs 36 for engaging bag plastic walls to be heat-sealed together and with a V-shaped topmost rib 36' for heat cutting the bag walls above the seal.

The forward end of each side 16 of the outer carriage 10 fixedly carries a downwardly extending bracket 37 fixedly supporting a double-acting hydraulic actuator 38 extending in a plane parallel to the channel members 9 and inclined at substantially 45° angle in such a manner that the cylinder 39 of the actuator 38 is fixed in the bracket 37 and its piston rod 40 extends upwardly therefrom.

Each carriage side 16 further supports, rearwardly of the brackets 37, an upwardly directed bracket 41 which in turn supports at its upper end a hydraulic actuator 42, which is double-acting. The cylinder 43 of the hydraulic actuator 42 is firmly secured to the bracket 41 in the plane of the actuator 38 and at a 45° inclination reverse from the actuator 38, so that both actuators are substantially perpendicular to each other.

Cylinder 43 has a piston rod 44 which downwardly extends therefrom.

Heads 45 and 46 are secured respectively to the piston rods 40 and 44 of the hydraulic actuators 38 and 42, respectively. These heads are prevented from rotating with respect to the associated cylinders 39 and 43 but are free to move back and forth along the arrows 47, under the action of the hydraulic actuators. For instance, each head 45, 46 has a guide rod 48, secured thereto, extending parallel to the associated piston rod and slidably guided within a hole of a plate 48' secured to the bracket holding the cylinders 39 and 43, respectively.

Figure 6:
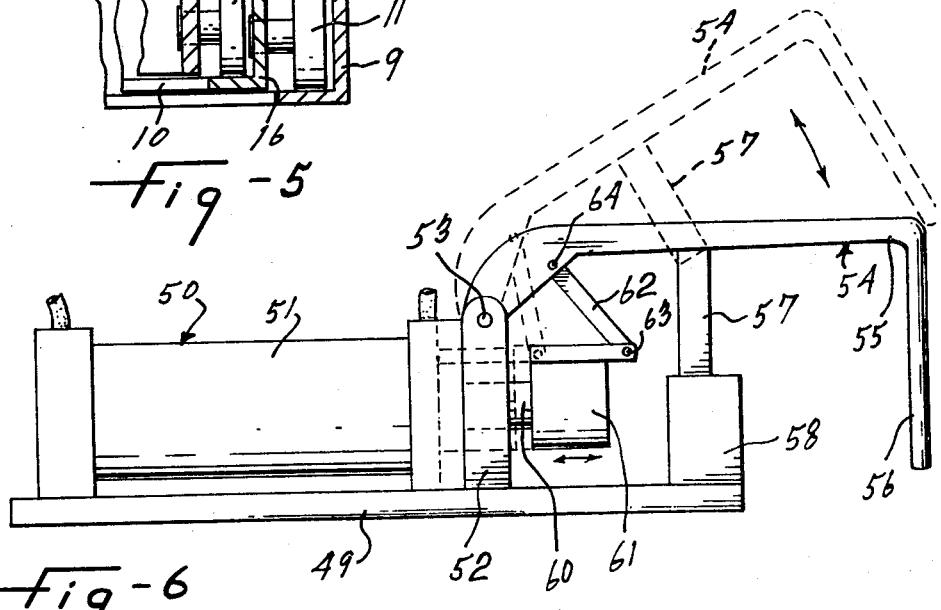
FIG. 6 is a side elevation of one of the four hooking fingers.
Figure 7:
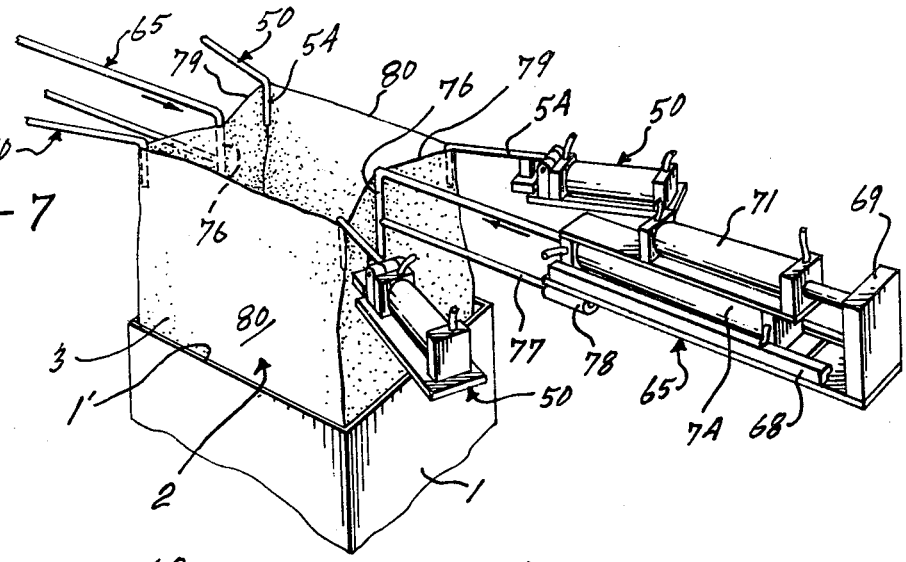
FIG. 7 is a perspective view of the open bag mouth and of the arrangement of the four hooking fingers and two pusher fingers emgaging the mouth and about to start the mouth folding and closing operation.
Figure 8:
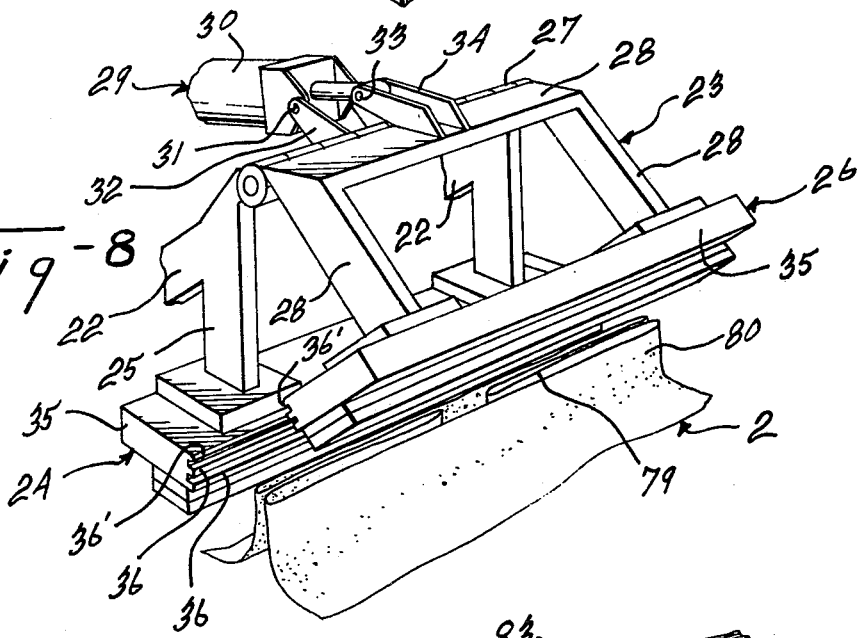
FIG. 8 is a perspective view of the heat sealer in partially opened position.

Each head 45, 46 forms a horizontal shelf 49 on which is mounted a hooking finger assembly. There are four hooking finger assemblies 50 arranged in pairs on opposite sides of the outer carriage. Each hooking finger assembly 50 is shown in FIG. 6 and comprises a horizontally disposed hydraulic actuator comprising a double-acting cylinder unit 51 secured to the shelf 49 having a head plate 52 to which is pivotally pivoted at 53 an L-shaped hooking finger 54 providing an inner section 55 and a free end section 56. In the operative position of the finger, section 55 is horizontal and section 56 is vertical. The finger is held in this position by means of a downwardly extending leg 57 depending from an intermediate portion of inner section 55 and abutting against a stop block 58 fixedly secured to shelf 49.

The piston rod 60 of the actuator 50 carries a head 61 linked to the hooking finger 54 by means of a link 62 pivoted at 63 to head 61 and at 64 to finger 54. Thus, movement of the piston rod head 61 will cause vertical pivotal movement of the hooking finger 54 between an upwardly inclined out-of-the-way position, shown in dotted lines in FIG. 6, to an operative down limit position, shown in full line with leg 57 abutting stop block 58.

Figure 2:
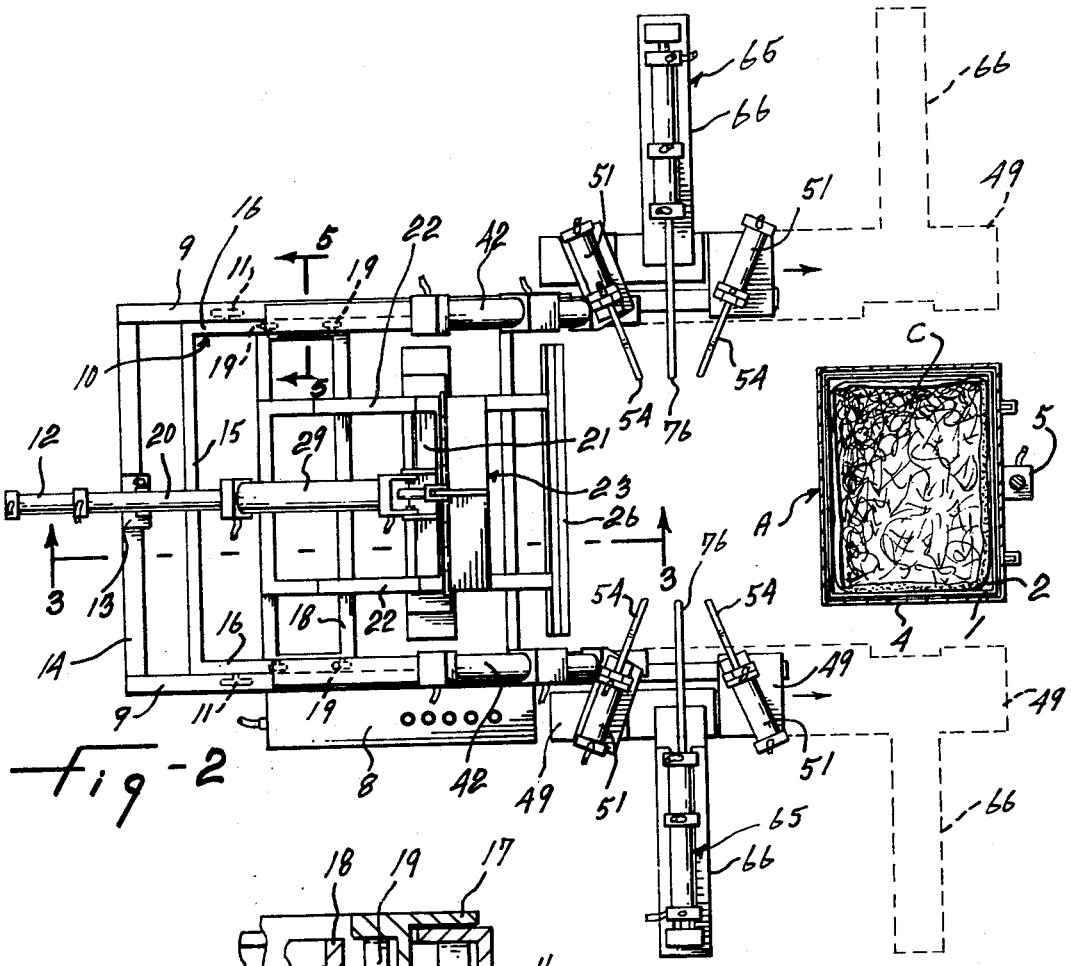
FIG. 2 is a top plan view of the machine in retracted position and also showing the bag-filling station in plan section.

The respective hooking finger assemblies 50 are mutually converging in a horizontal plane, as clearly shown in FIG. 2. They are disposed in pairs on opposite sides of the bag-closing station A and, consequently, of the bag located at said station.

Figure 4:
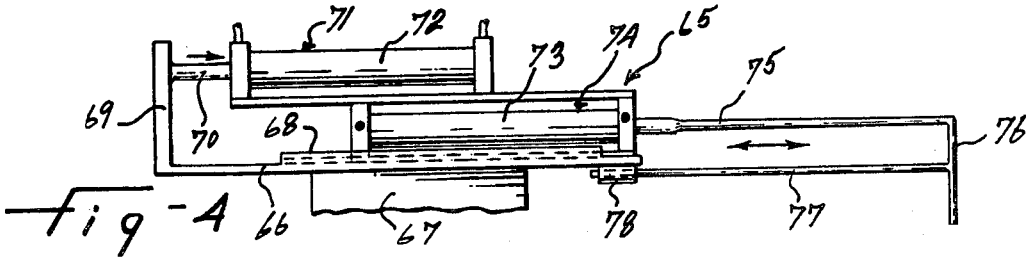
FIG. 4 is a side elevation of one of the two pusher finger systems.

There is provided a pusher finger assembly 65 arranged intermediate each pair of hooking finger assemblies 50. The two pusher finger assemblies 65 are oppositely disposed and the pusher fingers are arranged to move towards each other and away from each other in a plane at right angles to the direction of movement of the two carriages 10 and 18. The two pusher finger assemblies 65 are of identical construction and one of them is clearly shown in FIG. 4. It comprises a shelf 66 carried in a horizontal position by means of a support 67 secured to the top portion of the down bracket 37 carrying the hydraulic actuator 38.

Shelf 66 forms a horizontal guideway 68 and a back upstanding arm 69. The piston rod 70 of a first hydraulic actuator 71 is secured to the upper end of arm 69 and the cylinder 72 of actuator 71 is secured to the cylinder 73 of a second actuator 74, the latter partly underlying the first actuator 71. The second cylinder 73 is guided for horizontal displacement in the guideway 68. A piston rod 75 of the second actuator 74 has a downward extension at its outer end forming the pusher finger 76. This pusher finger 76 is maintained in vertical position against rotation by having a guide rod 77 secured thereto and slidable within a sleeve 78 secured underneath the shelf 66 at the forward end thereof. The serial arrangement of the two actuators 71 and 74 provides the necessary stroke of the pusher finger 76.

Figure 3:
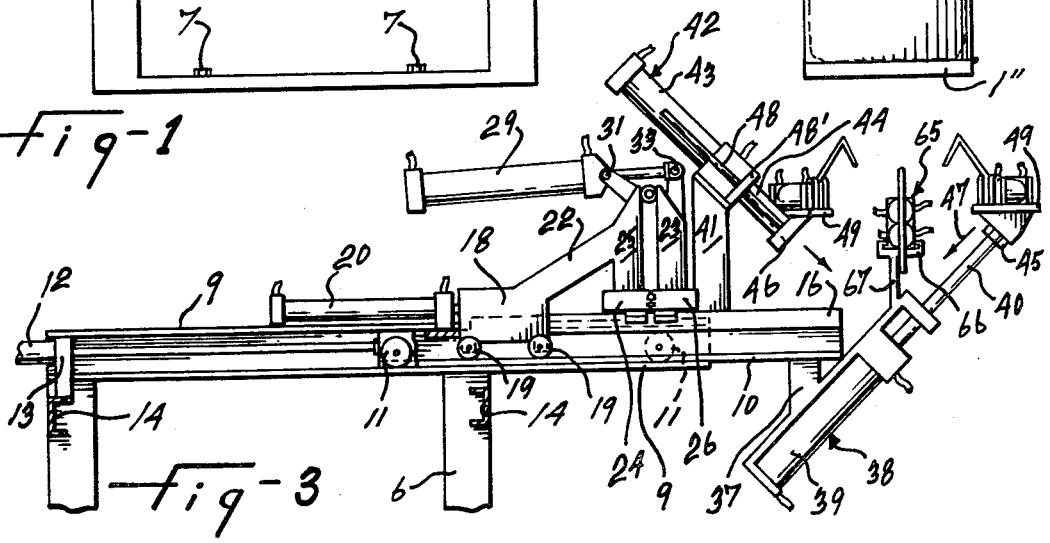
FIG. 3 is a partial longitudinal section of the machine taken along line 3—3 of FIG. 2.
Figure 11:
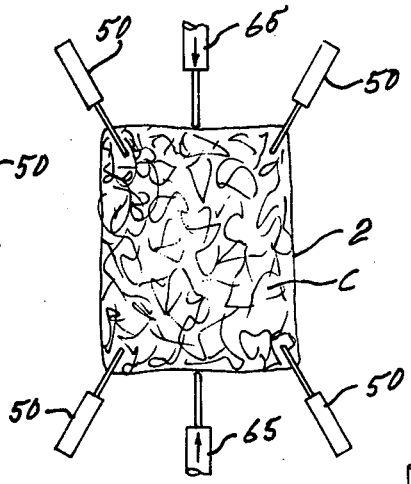
FIG. 11 is a top plan view of the arrangement of FIG. 10.

From the retracted position shown in FIG. 1, outer carriage 10 advances towards the bag 2 at station A under the action of first actuator 12. This brings the heat sealer 23, the pusher finger assemblies 65 and hooking finger assemblies 50 to the position of FIG. 3 with respect to the bag-closing station A, shown in FIG. 1; that is, the two pairs of hooking fingers and associated pusher finger are arranged opposite each side of the lower duct 1 across the same, as shown by the dotted line position of FIG. 2. The pusher fingers 76 are in retracted position under the action of their actuators 74 and 71, to thus clear the bag mouth walls 3. Similarly, the hooking fingers 54 are in their upwardly inclined pivoted position, as shown in dotted line in FIG. 6 and also in FIG. 3, to thus clear the top edge of the bag mouth walls 3. The four hooking fingers 54 are at the same level, the actuators 38, associated with the forwardmost hooking fingers, being in extended position, as shown in FIG. 3, while the actuators 42 associated with the rearmost hooking fingers are in retracted position. The cylinder units 51 are simultaneously operated to pivot the hooking fingers 54 downwardly, so that the vertical end sections 56 of said hooking fingers will move over the top edge of the bag 2 at the bag-closing station downwardly inside the bag at the four corners of the same, as clearly shown in FIGS. 10 and 11. Then the pusher fingers 76 are actuated to move towards each other. First, the actuators 71 are operated to cause pusher fingers 76 to engage the outside face of the end walls of the bag mouth and initiate the formation of center folds 79 in bag walls 3. Fingers 54 engage the inside face of the bag wall at the four corners of the bag and the slack in the bag wall is eliminated. The actuators 38 and 42 on both sides of the bag start to retract and extend repectively in synchronism so that the four hooking fingers 54 move down simultaneously in downwardly converging relationship for each pair of fingers on opposite sides of the bag. This causes the opposite side walls 80 of the bag mouth to gradually move towards each other and the resulting slack is automatically taken up by the pusher fingers 76 which continue to move towards each other against the end walls of the bag mouth to lengthen center folds 79 between the hooking fingers of each pair, and the downward movement of the hooking fingers 54 allows the bag mouth side walls 80 to drape themselves over the material C in the bag. This operation is clearly shown in FIGS. 12 and 13 and in FIGS. 14 and 15.

In the extended position of the pusher fingers 76 and closest and lowermost positions of hooking fingers 54, folds 79 have been completed and the opposite walls 80 are close together with the center folds in between. The resultant closure is now ready to be sealed.

Figure 9:
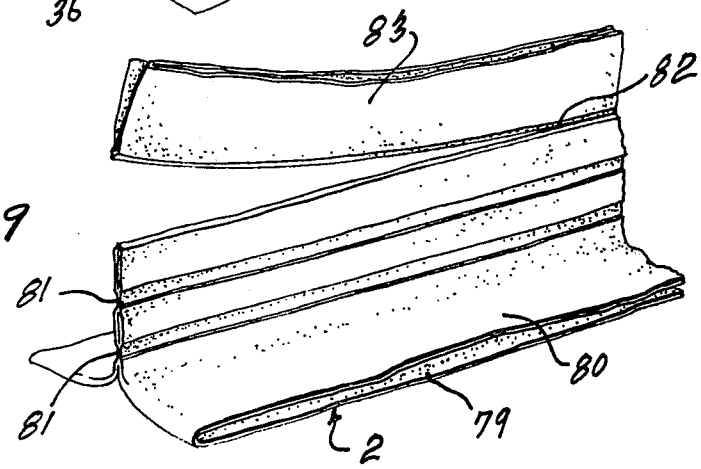
FIG. 9 is a partial perspective view of the closed and sealed bag mouth showing also the mouth excess walls which have been cut away by the heat sealer.

During the bag-closing operation, the heat sealer has remained in retracted position, as shown in FIG. 3, out of the way of the hooking and pushing fingers and clearing the bag. When the bag mouth is nearly closed, the heat sealer 23 advances inner carriage 18 being pushed by actuator 20. During the advancing movement, heat sealer jaw 26 is in upper opened position. The hooking and pushing fingers retract and the movable jaw 26 closes, so that the two jaws clamp therebetween the center folds 79 and the opposite side walls 80 of the bag mouth, as shown in FIGS. 16 and 17. The heated ribs 36 of the heat sealer jaws make two parallel spaced seals 81 (see FIG. 9) and the top V-shaped ribs 36' of the jaws cut by heat the bag walls along a line 82 spaced upwardly from the topmost heat seal, so as to cut off excess bag wall material, shown at 83 in FIG. 9. A perfect seal is obtained since the contacting faces of the bag mouth walls are free of any filling material C, because during all of the bag-closing and sealing operation, the walls of the mouth had remained vertical. Once the heat sealing has been completed, the pivoted jaw 26 of the heat sealer 23 opens to clear the bag and the two carriages 10 and 18 retract and the pusher fingers 76 and hooking fingers 54 take back their original position; the upper duct section 4 lowers; the trap door 1" of the lower duct section opens; and the sealed bag drops to a lower floor level and another filled bag with its mouth open drops down through the two duct sections onto the closed trap door 1" within the lower duct section. Then the duct section opens and a new bag-closing cycle starts.

Actual tests have shown that the entire bag closing and sealing operation can be easily effected within six seconds. The heat sealing operation takes no longer than 1½ second.

Although a heat seal has been shown, the machine being particularly adapted for closing and sealing thermoplastic bags, it is obvious that bags made of other material, such as paper, can be closed by the machine of the invention, it being only necessary to replace the heat sealer by a stapling machine, a stitching apparatus, or the like.

I claim:

1. A machine for closing the open mouth of a bag filled with material and supported in an upright position at a bag-closing station, with the walls of the bag mouth extending upwardly from the material filling the bag and defining two opposite end walls and two opposite side walls, said machine comprising a carriage movable in a substantially horizontal path towards and away from the bag-closing station between an advanced and a retracted position, respectively, and including two spaced substantially parallel supports positioned on opposite sides of an upstanding bag at said bag-closing station in the advanced position of said carriage, a pair of hooking means and a pushing means carried by each of said supports, with the pushing means located intermediate the hooking means of the pair and all located on opposite sides of the bag in the advanced position of the carriage and clearing said bag in the retracted position of said carriage, means operable when said carriage is in advanced position to cause said hooking means to engage the four corners of the bag mouth, said pushing means operable to engage the opposite end walls of the bag mouth intermediate the hooking means of each pair to form center folding of said end walls, and means to move the hooking means of each pair downwardly along converging inclined paths in a vertical plane substantially parallel to the associated end wall of the bag mouth to thus lower said hooking means and simultaneously approach the same towards the respective pushing means to allow said side walls to overlie the material filling the bag and to bring said side walls together in bag-closing position while allowing said pushing means to lengthen said center folds as said side walls approach each other.

2. A machine as claimed in claim 1, further including a second carriage carried by said first-named carriage and movable with respect to said first-named carriage in a horizontal position towards and away from the bag-closing station and bag mouth walls securing means carried by said second carriage registering with said bag mouth walls in the advanced position of said carriage and clearing said bag in the retracted position of said second carriage.

3. A machine as claimed in claim 2, wherein said bag-securing means include a pair of electrically-heated clamping jaws, one pivoted with respect to the other for pivotal movement in substantially vertical plane between jaw-open position and jaw-closed position, said jaws taking a position on top of said closed bag mouth in the advanced position of said second carriage, said jaws closable over the closed bag mouth and clamp the bag mouth walls to heat-seal the latter.

4. A machine as claimed in claim 1, wherein each of said heat-sealing jaws comprises an electrically-heated block having bag mouth wall-engaging faces provided with a pair of spaced parallel ribs and a third uppermost rib parallel to the remaining two ribs and of V-shaped cross-section to define a sharp edge, the ribs of the two jaws arranged in registering relationship in the closed position of the jaws, the ribs of the two first-named pairs effecting spaced parallel seals in the bag mouth walls and the V-shaped ribs effecting cutting of the bag mouth walls.

5. A machine as claimed in claim 1, wherein each of said hooking means includes a bracket, an L-shaped hooking finger pivotally mounted on said bracket for pivotal movement in a vertical plane between an elevated position in which the hooking finger is adapted to clear the top edge of the bag mouth and a lowered position with the hooking finger extending downwardly within the bag mouth, an actuator to pivot said hooking finger between said two positions and said means to move the hooking means along inclined paths including for each hooking means a fluid-operated cylinder and piston unit, the cylinder of which is secured to said support in inclined position along said inclined path and the piston rod of which is secured to, and supports said bracket.

6. A machine for closing the open mouth of a bag filled with material and supported in upright position at a bag-closing station with the walls of the bag mouth upstanding from the material filling the bag and defining two opposite end walls and two opposite side walls, said machine comprising a pair of spaced supports positioned along and horizontally spaced outwardly from the respective end walls, a pair of fluid-operated cylinder and piston units carried by each support, the cylinder of each of said units being secured to the respective support in an inclined position in a substantially vertical plane substantially parallel with the respective end walls of said bag mouth, the two cylinders of the pair being equally inclined to the vertical, but in opposite directions, said units each having a piston rod, a bracket secured to the outer end of each piston rod, an L-shaped hooking finger pivotally mounted on each bracket for pivotal movement in a vertical plane, the four hooking fingers mutually converging in a horizontal plane and aligned with the respective four corners of the walls of the bag mouth, an actuator mounted on each bracket for pivoting the associated hooking finger between an upwardly extending out-of-the-way position clearing a bag at said bag-closing station and a lowered position extending over the top edge of the bag and downwardly inside one of the four corners of the walls of the bag, a pusher finger mounted on each support intermediate the hooking fingers and directed inwardly towards an end wall of a bag at said bag-closing station, an actuator to cause said pusher finger to move horizontally and engage said bag end wall and form center folding of said bag end wall, said cylinder and piston units lowering said hooking fingers while said pusher fingers move towards said end walls to allow said side walls to overlie the material-filling bag and to bring said side walls together in bag-closing position, said machine further including a carriage substantially horizontally movable towards and away from said side walls, a bag mouth wall securing means mounted on said carriage, an actuator to move said carriage to an advanced position with said bag wall securing means overlying and registering with the closed bag walls and a retracted position with said securing means clearing the bag, and actuator means to actuate said bag mouth walls securing means while said carriage is in advanced position.

7. A machine as claimed in claim 6, wherein said bag mouth wall securing means include a pair of electrically-heated clamping jaws, one pivoted with respect to the other for pivotal movement in a substantially vertical plane between jaw-open position and jaw-closed position, said jaws closable over the closed bag mouth to clamp the bag mouth walls and heat-seal the latter, each of said heat-sealing jaws comprising an electrically-heated block having bag mouth wall-engaging faces provided with a pair of spaced parallel ribs and a third uppermost rib parallel to the remaining two ribs and of V-shape cross-section to define a sharp edge, the ribs of the two jaws arranged in registering relationship in the closed position of the jaws, the ribs of the two first-named pairs effecting spaced parallel seals in the bag mouth walls and the V-shape ribs effecting cutting of the bag mouth walls.

* * * * *